US005454252A

United States Patent [19]

Mueller

[11] Patent Number: 5,454,252

[45] Date of Patent: Oct. 3, 1995

[54] CAN BODY MAKER APPARATUS WITH FLEXIBLE REDRAW SLEEVE

[75] Inventor: Peter M. Mueller, Littleton, Colo.

[73] Assignee: Aluminum Company of America, Pittsburgh, Pa.

[21] Appl. No.: 174,134

[22] Filed: Dec. 28, 1993

[51] Int. Cl.[6] ..... B21D 22/28

[52] U.S. Cl. ..... 72/349; 72/350

[58] Field of Search ..... 72/347, 349, 350, 72/351

[56] References Cited

U.S. PATENT DOCUMENTS 2,980,046 4/1961 McGregor et al. ..... 72/350

3,296,850 1/1967 Fiore ..... 72/351

3,793,871 2/1974 Kinghorn ..... 72/349

*Primary Examiner*—Lowell A. Larson

*Attorney, Agent, or Firm*—Thomas R. Trempus

[57] ABSTRACT

In a can body maker for the forming of a shallow metal cup blank into a relatively deep shaped cup body, a redraw sleeve for use in a redraw mechanism has a generally cylindrical body portion with a first end adapted to engage the redraw mechanism and an opposite, second end for contact with the shallow cup blank during the forming of the deep shaped cup body. The second end has a radially inwardly directed, circumferentially disposed, deformable face that facilitates uniform contact with the metal cup while compensating for minor misalignment of the cup and ram.

23 Claims, 3 Drawing Sheets

CAN BODY MAKER APPARATUS WITH FLEXIBLE REDRAW SLEEVE

FIELD OF THE INVENTION

This invention relates generally to can body makers and more particularly to the redraw sleeve of the redraw system of the can body maker. The redraw system consists of a motion assembly that reciprocates a redraw sleeve between a retracted position to a work position. In the work position, the redraw sleeve engages a shallow metal cup. Immediately thereafter, the body maker ram contacts the cup and begins the redraw operation, elongating the sidewalls of the cup while decreasing the sidewall thickness and overall diameter of the cup.

BACKGROUND OF THE INVENTION

A conventional can body maker apparatus is disclosed in U.S. Pat. No. 3,696,659, issued to J. H. Maytag and assigned to Adolph Coors Company. The contents of this patent are incorporated herein by reference as if fully set forth herein. An example of a conventional redraw system is disclosed in U.S. Pat. No. 3,735,629, issued to Elpidofor Paramonoff, and assigned to Standun Inc., also incorporated by reference as if fully set forth. The assignee of the instant invention is also the assignee of copending application, "Improved Body Maker Apparatus," Serial No. 899,201, which discloses a counterbalance mass system that improves the speed and efficiency of can body makers.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates typically sufficient to form from between 180 and 220 can bodies per minute. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. In conjunction with the reciprocal motion of the ram, a redraw sleeve is supported in a redraw assembly. The redraw sleeve engages the shell prior to contact by the ram, and applies a restraining force against the shell as the shell is worked through a redraw die. The redraw process elongates the sidewalls of the can shell and decreases the sidewall thickness and overall diameter of the can shell. The redraw operation is followed by two or three ironing stations that further elongate and thin the walls of the can shell to form a one piece can body. The body maker typically includes a doming station that further forms the enclosed bottom of the can body into a desired structural configuration.

The redraw assembly operates at the same rate as the ram assembly. Mechanical linkage is provided between the main crank shaft of the can body maker and both the ram assembly and the redraw assembly. Needless to say, a significant amount of mass is being reciprocated in the redraw carriage assembly and this mass can contribute to the misalignment problem discussed above. Heretofore, it had been the practice to provide a redraw sleeve with an internal bore of a constant diameter. The ram passes through the bore of the sleeve. The bore is of sufficient diameter to relative to the outside diameter of the ram to provide clearance as the ram passes through the bore of the sleeve. The shell contacting surface in such conventional redraw sleeves is the terminal portion of the thick walled sleeve, i.e., the forward portion of the sleeve between its inner and outer cylindrical surfaces. Such conventional redraw sleeves possess significant mass and are subject to minor misalignment during the initial moments of the redraw process. During the redraw process, the redraw sleeve can maintain a pressure of approximately 1,700 pounds of pressure on the can shell. Too little pressure will result in wrinkling, too much pressure will permit the ram to tear through the shell. The redraw sleeve must apply uniform pressure against the shell or the redrawn workpiece will be irregular in appearance and non uniform in thickness and dimension.

SUMMARY OF THE INVENTION

The invention provides an improved redraw sleeve for use in a can body maker or the like in which can bodies are formed from shallow metal cup blanks through a redrawing and ironing process. Redraw sleeves are mounted in redraw assemblies that include a drive mechanism that imparts straight line reciprocal motion to the redraw sleeve. The redraw sleeve of the instant invention includes a generally cylindrical body portion with a first end adapted to engage the redraw assembly. An opposite, second end of the redraw sleeve contacts the shallow cup blank indexed into the tool pack of the body maker. The redraw sleeve second end has a radially inwardly directed, circumferentially disposed, deformable face. The radially inwardly directed, circumferentially disposed, deformable face defines an internal step like feature at the juncture of the deformable face and the inner wall of the cylindrical body portion. The deformable face has an inner surface and an outer surface and the outer surface in one embodiment is substantially perpendicular to the cylindrical body portion. Additionally, the outer surface can be substantially parallel to said inner face. Preferably, the radially inwardly directed, circumferentially disposed, deformable face is integral with the cylindrical body portion. In alternative embodiments, the deformable face is disposed to cooperate with the die face of the drawing tools.

Further features of the redraw sleeve can include providing a radially inwardly directed, circumferentially disposed, deformable face that can be uniform in thickness or non-uniform in thickness. For example, the deformable face can taper from a first thickness proximate the cylindrical body portion to a second, lesser thickness distal the cylindrical body portion. Further, the deformable face can taper outwardly from a plane defined by the second end of the cylindrical body portion. The deflection can be at an angle greater than zero to an angle up to approximately five (5) degrees. Consideration must be given to the configuration of the die face against which the redraw sleeve exerts pressure during the redraw process. As die face geometry varies, the deformable face is adapted to cooperate with the die face surface to provide the desired pressure against the shallow cup blank.

The redraw sleeve of this invention can be incorporated into convention redraw sleeve mounting configurations or it can be configured for mounting in other ways, such as, for example, a bayonet mount adapted to engage a complementary bayonet mount in the redraw sleeve assembly, threaded connectors, or the like. The conventional mounting structure present in existing can bodymakers typically includes a frustoconical member with an outer surface adapted to engage a complementary seat in the redraw sleeve assembly.

It is an object of this invention to provide an improved redraw sleeve having a flexible can shell contacting surface.

It is another object of this invention to provide a redraw sleeve that can be retrofitted into a can body maker redraw assembly.

It is yet another object of this invention to increase the speed at which body makers can effectively operate.

It is also an object of this invention to provide a can body apparatus capable of consistently producing a can body formed to precise tolerances and substantially reduce the manufacture of defective cans.

It is still another object of this invention to provide a redraw sleeve having greater tolerance in alignment criteria due to the adaptability of the redraw sleeve structure to the die geometry.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
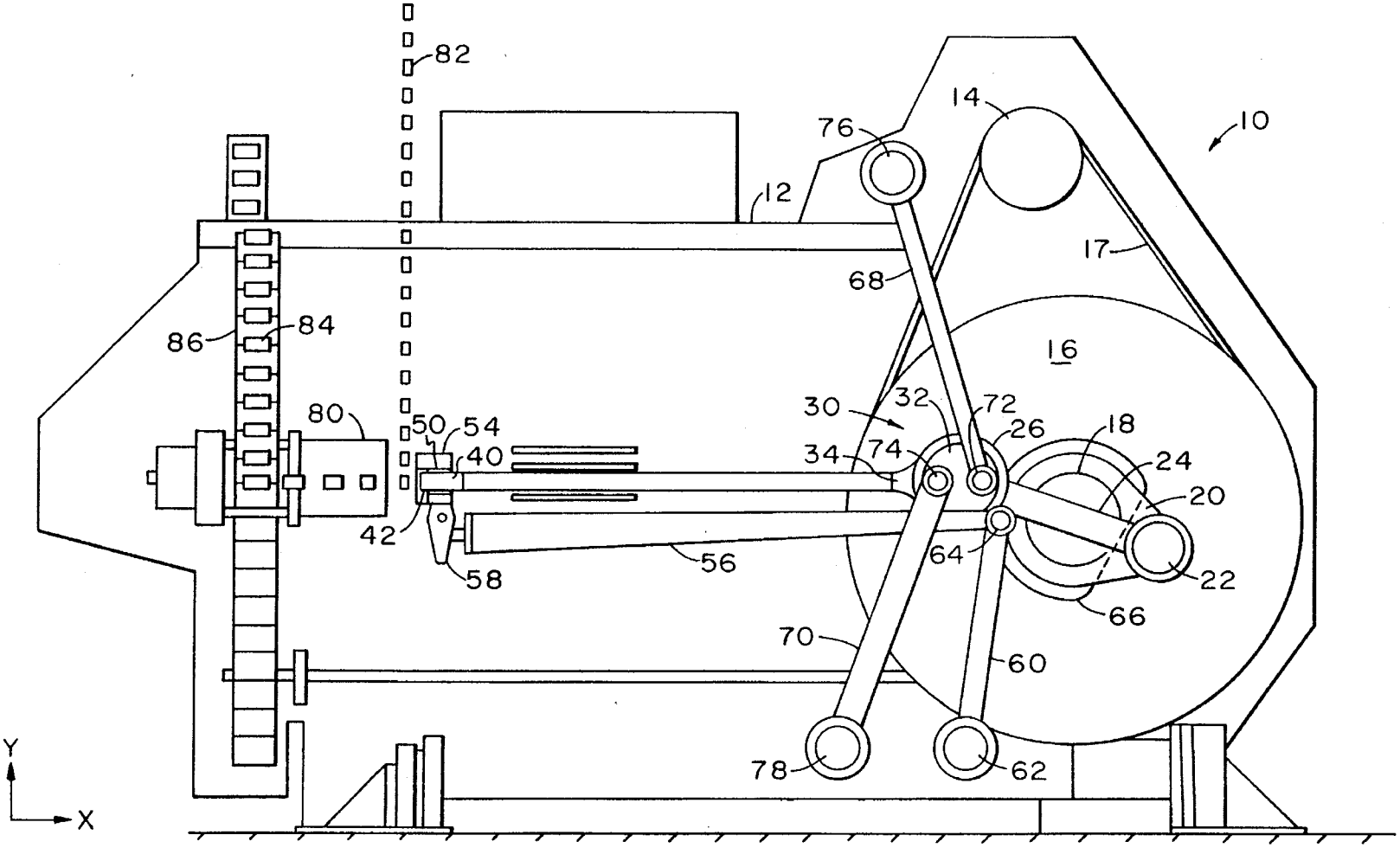
FIG. 1 is an somewhat diagrammatic view of a can body maker apparatus into which the redraw sleeve of this invention can be incorporated.

In order to fully appreciate the various aspects of this invention, it is critical to understand first the operation of a typical can body maker apparatus. Turning now to FIG. 1, a conventional can body maker is generally indicated by the reference character 10. The can body maker 10 includes a frame or housing structure 12 having mounted thereon a motor 14 that drives a large pulley wheel 16 by a belt 17. The pulley wheel 16 is fixedly mounted on one of a pair of transversely extending axially aligned crankshafts 18 with crank arms 20. The crankshafts 18 are rotatable in bearings mounted in opposite sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 30. The pivotal point of the assembly is designated 32. The cross head member 26 is engaged circumferentially by the end of a carriage connecting rod 34. The carriage connecting rod 34 is connected at its other end to a ram assembly 40, in which is mounted a ram 42.

A redraw sleeve assembly 50 (onto which is mounted a redraw sleeve according to the present invention as described below) is mounted at its rearward end to a redraw carriage 54. The redraw carriage 54 is pivotally connected to a downwardly directed rocker arm 58. The rocker arm can be connected at either one side, or at both its right and left sides, to an elongated redraw sleeve actuating bar 56 that generally is parallel to the ram 42 and movable in longitudinal, or X axis, direction independently of the ram. Each actuating bar 56 is adapted at its rearward end to support a cam follower lever which has its lower end mounted on a fixed pivot 62 on the frame 12. The upper end of the cam follower lever 60 includes a cam follower 64 for contacting a cam surface 66 on the crank assembly for transmitting the rotary action of the crank into the reciprocal motion of the redraw sleeve assembly.

The ram or straight line motion assembly 40 includes a side thrust resisting, upper swing lever 68 and lower swing lever 70, both bifurcated at their inner ends so as to straddle the cross head member 26. The upper swing lever 68 is pivotally connected to the cross head member 26, as indicated at 72, and the lower swing lever 70 is pivotally connected at 74 to the cross head member 26. The upper end of the upper swing lever 68 is pivotally connected to the fixed pivots 76 on frame members 12, and the lower end of the lower swing lever 70 is pivotally connected to the fixed pivots 78 on frame members 12.

A tool pack housing 80, mounted in the left hand portion of the can body maker as illustrated in FIG. 1, encloses a series of drawing and ironing dies (not shown) through which a workpiece such as a cup 82 is worked by the ram in combination with the redraw assembly 50. The cup 82 is drawn and ironed into a can body 84 and a suitable transport system 84 conveys the can body 84 from the body maker 10.

The redraw sleeve assembly 50 and actuating bar 56 move forwardly and rearwardly as the cam followers 64 travel along the rotating cam surface 66. The high point of the cam travel urges the actuating bar in a forward direction, i.e., towards the front of the can body maker during a first part of the redraw cycle; subsequently, in a second part of the redraw cycle, the actuator bar 56 is urged rearwardly, i.e., away from the forward end of the can body maker by means of the rotation of the cam to a low point and the force imparted by means of a return mechanism (not shown). The return mechanism maintains the actuating bar 56 under compression, forcing the cam follower against the cam surface. The return mechanism typically comprises a complex air spring assembly that includes an air cylinder, surge tank, and lines. The air spring assembly applies pressure against the actuating bar to maintain the bar in compression throughout the redraw process cycle of the redraw cam through the actuating bar and cam followers. The return mechanism maintains contact between the cam followers 48 and the cam face.

Figure 3:
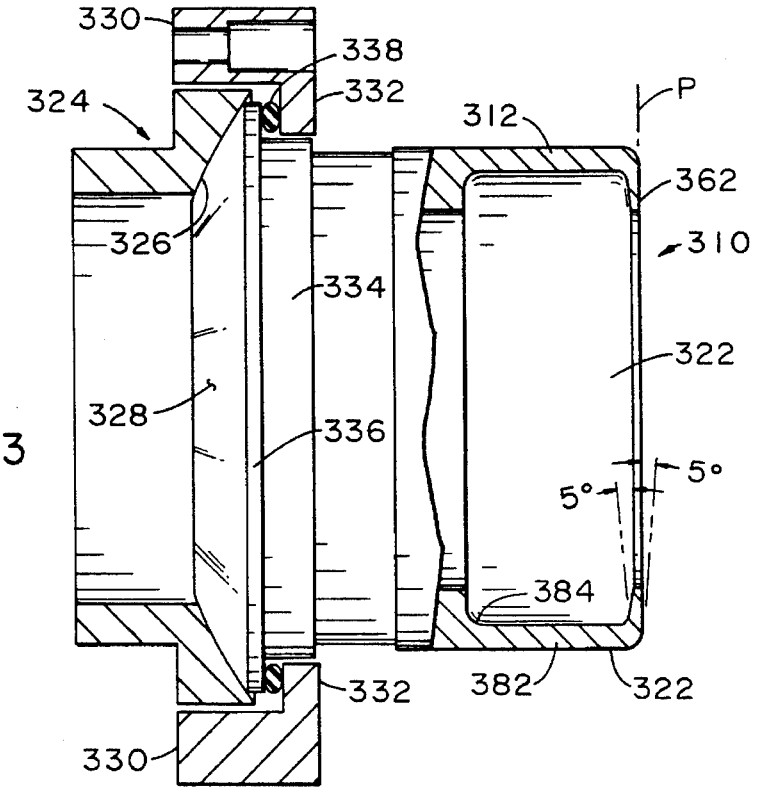
FIG. 3 is side elevational view of a redraw sleeve, with sections cut away all according to the instant invention and mounted in a conventional redraw assembly.
Figure 2:
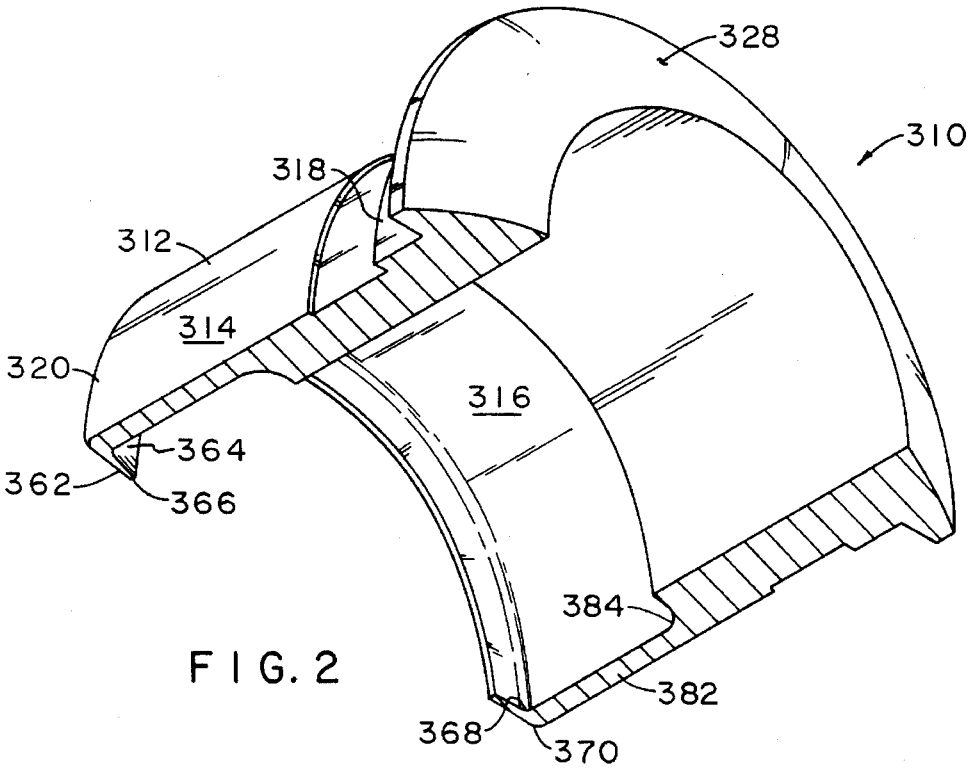
FIG. 2 is a perspective, sectional, view of the redraw sleeve of this invention.
Figure 4:
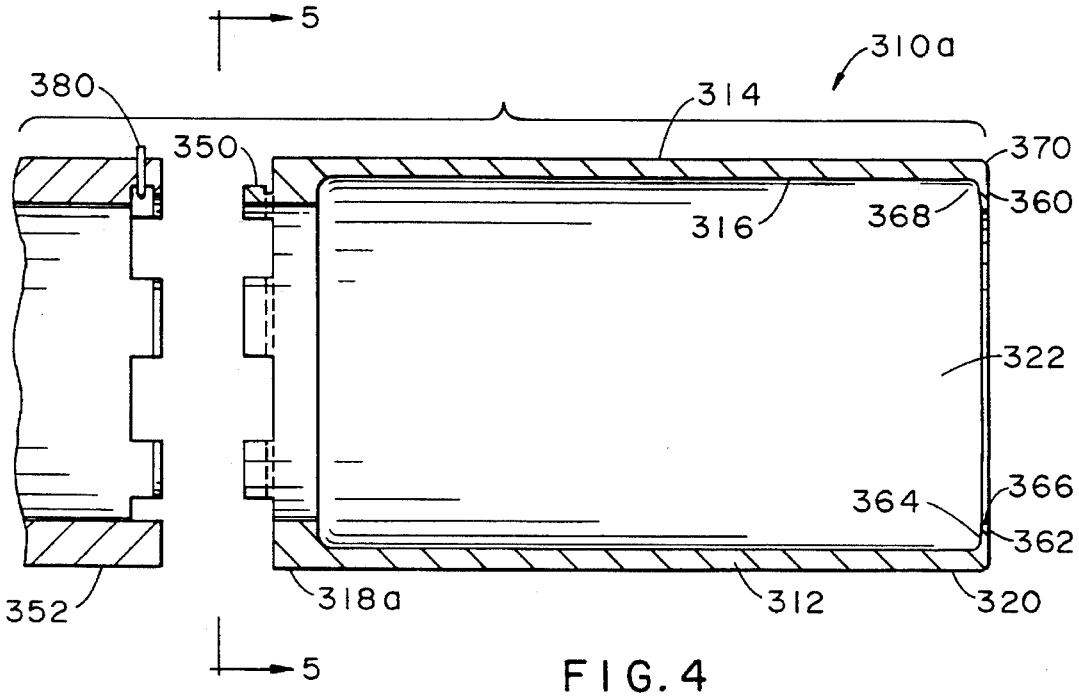
FIG. 4 is a side elevation, sectional view of a redraw sleeve according to the present invention in an alternative embodiment for mounting into a redraw assembly.

The redraw operation is the most important function in the can making process. The redraw sleeve assembly 50 is located in front of the ram 40 next to the die housing assembly 80. The redraw carriage 54 provides the alignment structure for the redraw sleeve 310 (FIGS. 2 through 4). Generally, the redraw sleeve 310 aligns the metal cup 82 during the redraw operation and provides the tooling necessary to apply pressure against the redraw die 80.

In order to maintain an accurate thin-wall dimension, it is desirable that a minimum draw pressure be applied evenly around the cup and the redraw sleeve aligned precisely relative to the ram and the cup according to pre-established specifications. If a minimum pressure on the cup is not evenly maintained or if the redraw sleeve is not precisely aligned, quality problems in the drawing and ironing process may result. Such problems include extensive wear or damage to the redraw motion assemblies, the redraw sleeve itself, and can bodies which have extensive damage. Can body damage can include flange wrinkling under the face of the redraw sleeve, can shell crushing, and can shell misfeed, and ultimate shutdown of the equipment.

According to the present invention a redraw sleeve 310 has a configuration that makes it adaptable for use in existing can body maker apparatus as well as the improved can body maker systems incorporating the unique redraw system disclosed in applicants co-pending U.S. patent application Ser. No. 174,232. Turning to FIGS. 2 through 5, the redraw sleeve 310 includes a cylindrical body portion 312 having an outer surface 314 and an inner surface 316. The cylindrical body 312 has a first end 318 and a second end 320. The cylindrical body portion 312 defines a central bore 322 through which a body maker ram passes. The redraw sleeve 310 is suitable for retrofit into existing body makers redraw systems as shown in FIGS. 1 and 3. The first end 318 of the cylindrical body is adapted to be removably mounted into a redraw carriage sleeve assembly generally indicated at 324. The assembly 324 includes a seat portion with a face 326 adapted to conform to the spherical surface 328 of the first end 318. The assembly 324 includes a locking member 330. The locking member 330 includes an inwardly directed circumferentially disposed locking feature 332 which is adapted to engage a seat 334 defined by a circumferentially disposed outwardly extending wall 336. It is conventional practice to insert an O-ring between the locking feature 332 and the wall 336 to retain the redraw sleeve 310 within the assembly 324 of the redraw carriage. The combination of the spherical seat 318 of the cylindrical body, the 0-ring 338, and the locking member 330 retains the redraw sleeve in a relatively fixed position with respect to the redraw carriage. By relatively fixed position it is meant that some degree of flexibility is afforded by the conical seat and O-ring. Slight misalignment between the redraw sleeve 310 and the can body maker ram can be compensated for by the flexibility afforded in this mounting configuration.

Figure 5:
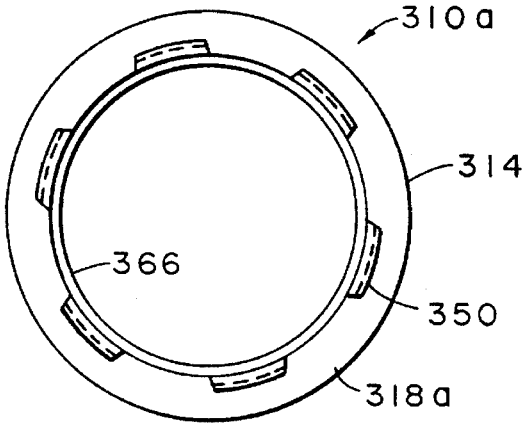
FIG. 5 is an elevational view of the alternative mounting embodiment of the redraw sleeve shown in FIG. 4.

In an alternative embodiment of this invention, a new and improved mounting structure is provided. Turning now to FIGS. 4 and 5, a redraw sleeve **310*a* includes a cylindrical body portion 312. The cylindrical body portion 312 includes an outer surface 314 and an inner surface 316. A first end 318*a* is adapted to be mounted onto a redraw carriage. The second end 320 contacts a shallow cup during the forming of the deep shaped cup body. The first end 318*a* includes a bayonet-style locking structure generally indicated by the referenced character 350. A redraw carriage assembly includes the female half 352 of the bayonet mount structure. A locking pin as at 380 can be inserted into the sleeve and redraw carriage bayonet mount in order to inhibit undesired displacement of the sleeve relative to the carriage. It should be appreciated that any number of techniques can be employed to rigidly yet detachably secure the sleeve 310** into the redraw carriage. For example, the redraw sleeve can include a threaded coupling that cooperates with a complementary threaded system in the redraw carriage.

The second end 320 of the cylindrical body 312 which forms the redraw sleeve 310 includes a radially, inwardly directed, circumferentially disposed deformable member 360. The deformable member defines a bore 322 through which the ram of the can body maker passes during the redraw of a shallow cup. The deformable face 360 includes a shell contacting surface 362 and an opposed surface 364. The contacting surface 362 and the opposed surface 364 extend from the second end of the cylindrical body 312 and are joined by a wall 366. As can be seen, the opposed surface 364 in combination with the inner surface 316 of the cylindrical body forms a step portion 368. This internal step-like feature is at the juncture of the deformable member and the cylindrical body portion. The inside diameter of the circle defined by the wall 366 of the deformable face 360 is slightly greater than the outside diameter of the ram. The ram must pass through the central bore of the sleeve and the opening defined by the wall 366 during the drawing and ironing process. Heretofore, it had been the practice to provide a bore of a predetermined diameter selected to provide adequate clearance for the ram as it passes through the sleeve. Such prior art redraw sleeves possess significant mass. The shell contacting surface in the prior art design is the terminal portion of the thick walled sleeve, i.e., the forward portion of the sleeve between its inner and outer surfaces.

The redraw sleeve of this invention provides a significant advancement over current practice. For example, as shown in FIG. 4, in one embodiment, the contacting surface 362 is substantially perpendicular to an axis defined by the cylindrical body portion 312. Preferably, the deformable member 360 is an integral portion of the cylindrical body portion 312. The radially, inwardly directed, circumferentially disposed, deformable member can be non-uniform in thickness. The deformable member can taper from a first thickness, approximate the cylindrical body as at the juncture 368, to a second, lesser thickness distal the cylindrical body portion, or at the wall 366. In an alternative embodiment as shown in FIG. 3, the contacting surface 362 is at an angle that is greater than zero, up to approximately 5° (as shown in phantom) relative to a plane "P" drawn through the outside edges 370 of the cylindrical body 312. The cylindrical body portion 312 experiences some deformation and stiffness and spring rate can be modified by changes to the sidewall geometry, including for example local relief slots and wall thickness, as well as by modifications to the material properties of the sleeve. In operation, the portion of the deformable member approximate the wall 366 first contacts the shallow cup inner surface. Any misalignment in the redraw sleeve 310 is compensated for by the flexibility of the deformable member 360. This tends to ensure that a uniform minimum distribution of force is applied to the shallow cup immediately prior to the contact of the shell cup by the can body maker ram.

In existing can body redraw sleeves, it is the practice to provide a cylindrical body of a constant thickness that terminates an edge which contacts the shallow cup. In such arrangements it is the actual end of the wall forming the cylindrical body which contacts the shallow cup. This results in a rather thick-walled redraw sleeve having significant mass. In the instant invention, the total mass of the redraw sleeve is significantly reduced through the use of the thin cylindrical wall in combination with the deformable member. As shown in FIG. 2, the thin wall section 382 of the cylindrical body 312 eliminates a significant total portion of the mass of the cylindrical body between the rearward step section 384 and the forward step section or juncture 368. The width of the deformable member as measured from the outside of the cylindrical body 370 to the inside wall 366 is comparable to the width of the prior art thick-walled redraw sleeves. Significant improvements are available due to the light weighting and consequent reduction of mass being displaced by the redraw carriage during can body making operations.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. In a can body maker and the like of the type for the forming of a shallow metal cup blank into a relatively deep shaped cup body, said can body maker having a drive mechanism operably connected to a redraw mechanism that includes a horizontally reciprocal redraw sleeve assembly adapted to receive therein a redraw sleeve that engages the shallow cup blank against a die face, the improvements comprising: said redraw sleeve having a generally cylindrical body portion with a first end adapted to engage said sleeve assembly for removable mounting said sleeve thereto, and an opposite, second end for contact with the shallow cup blank during the forming of the deep shaped cup body, said second end having a radially inwardly directed, circumferentially disposed, deformable face.

2. The improved redraw sleeve of claim 1 wherein the radially inwardly directed, circumferentially disposed, deformable face defines an internal step like feature at the juncture of said deformable face and the cylindrical body portion.

3. The improved redraw sleeve of claim 1 wherein the radially inwardly directed, circumferentially disposed, deformable face has an inner surface and an outer surface and wherein the outer surface is substantially perpendicular to the cylindrical body portion.

4. The improved redraw sleeve of claim 1 wherein the radially inwardly directed, circumferentially disposed, deformable face has an inner surface and an outer surface and wherein the outer surface is substantially perpendicular to the cylindrical body portion and is substantially parallel to said inner face

5. The improved redraw sleeve of claim 1 wherein the radially inwardly directed, circumferentially disposed, deformable face is integral with the cylindrical body portion.

6. The improved redraw sleeve of claim 1 wherein the radially inwardly directed, circumferentially disposed, deformable face is non-uniform in thickness tapering from a first thickness proximate the cylindrical body portion to a second, lesser thickness distal the cylindrical body portion.

7. The improved redraw sleeve of claim 1 wherein the radially inwardly directed, circumferentially disposed, deformable face tapers outwardly from a plane defined the second end of the cylindrical body portion.

8. The improved redraw sleeve of claim 7 wherein the radially inwardly directed, circumferentially disposed, deformable face tapers outwardly from a plane defined the second end of the cylindrical body portion at an angle greater than zero and up to approximately 5 degrees.

9. The improved redraw sleeve of claim 7 wherein the radially inwardly directed, circumferentially disposed, deformable face is conformable to the die face.

10. The improved redraw sleeve of claim 1 wherein the first end adapted to be removably mounted in the sleeve assembly includes a bayonet mount adapted to engage a complementary bayonet mount in the redraw sleeve assembly.

11. The improved redraw sleeve of claim 1 wherein the first end adapted to be removably mounted in the sleeve assembly includes a frustoconical member with an outer surface adapted to engage a complementary seat in the redraw sleeve assembly.

12. A redraw sleeve for use in a redraw assembly of a can body maker and the like of the type used for the forming of a shallow metal cup blank into a relatively deep shaped cup body, comprising: a generally cylindrical body portion with a first end adapted to be removably mounted in said redraw assembly whereby said redraw sleeve is supported in said redraw assembly, and an opposite, second end for contact with the metal cup blank during the forming of the deep shaped cup body, said second end having a radially inwardly directed, circumferentially disposed, deformable face.

13. The improved redraw sleeve of claim 12 wherein the radially inwardly directed, circumferentially disposed, deformable face defines an internal step like feature at the juncture of said deformable face and the cylindrical body portion.

14. The improved redraw sleeve of claim 12 wherein the radially inwardly directed, circumferentially disposed, deformable face has an inner surface and an outer surface and wherein the outer surface is substantially perpendicular to the cylindrical body portion.

15. The improved redraw sleeve of claim 12 wherein the radially inwardly directed, circumferentially disposed, deformable face has an inner surface and an outer surface and wherein the outer surface is substantially perpendicular to the cylindrical body portion and is substantially parallel to said inner face.

16. The improved redraw sleeve of claim 12 wherein the radially inwardly directed, circumferentially disposed, deformable face is integral with the cylindrical body portion.

17. The improved redraw sleeve of claim 12 wherein the radially inwardly directed, circumferentially disposed, deformable face is non-uniform in thickness tapering from a first thickness proximate the cylindrical body portion to a second, lesser thickness distal the cylindrical body portion.

18. The improved redraw sleeve of claim 12 wherein the radially inwardly directed, circumferentially disposed, deformable face tapers outwardly from a plane defined the second end of the cylindrical body portion.

19. The improved redraw sleeve of claim 18 wherein the radially inwardly directed, circumferentially disposed, deformable face tapers outwardly from a plane defined the second end of the cylindrical body portion at an angle greater than zero and up to approximately 5 degrees.

20. The improved redraw sleeve of claim 12 wherein the first end adapted to be removably mounted in the sleeve assembly includes a bayonet mount adapted to engage a complementary bayonet mount in the redraw sleeve assembly.

21. The improved redraw sleeve of claim 20 wherein the first end adapted to be removably mounted in the sleeve assembly by means of a bayonet mount adapted to engage a complementary bayonet mount in the redraw sleeve assembly further includes locking means to deter relative displacement of the sleeve relative to the redraw sleeve assembly.

22. The improved redraw sleeve of claim 12 wherein the first end adapted to be removably mounted in the sleeve assembly includes a frustoconical member with an outer surface adapted to engage a complementary seat in the redraw sleeve assembly.

23. A tool for use in a metal forming system for providing resistance against metal to be formed in a drawing process comprising: a generally cylindrical body portion having one end with a radially inwardly directed, circumferentially disposed, deformable face that contacts the metal during the drawing process.

* * * * *